United States Patent [19]

Aragona

[11] Patent Number: 5,022,197

[45] Date of Patent: Jun. 11, 1991

[54] STAIRWAY SAFETY BARS

[76] Inventor: Joel Aragona, 328 W. 89th St., New York, N.Y. 10024

[21] Appl. No.: 457,096

[22] Filed: Dec. 26, 1989

[51] Int. Cl.[5] ..... B66B 9/00

[52] U.S. Cl. ..... 52/29; 52/183; 52/184

[58] Field of Search ..... 52/183, 184, 29; 135/65, 67; 193/38

[56] References Cited

U.S. PATENT DOCUMENTS 1,785,487 12/1930 McAvoy ..... 52/29 X 4,253,287 3/1981 Overmoe ..... 135/65 X

*Primary Examiner*—Henry E. Raduazo

*Assistant Examiner*—Linda J. Hoffert

*Attorney, Agent, or Firm*—Marvin Feldman

[57] ABSTRACT

A pair of parallel safety bars are track-mounted above the stairs of a stairway. The safety bars are formed so as to be gripped by the user in ascending or descending the stairs. The user steps between the bars, with each bar being hinged to permit such access, and grabs the bar in the direction of ascent or descent. The track-mounted end of the bar is pivotally connected to a shoe which slides in the track as the person moves on the bar downwardly on the bar or the weight of the user pulls the bar downwardly, friction braking elements on the shoe and in the track are contactingly engaged to restrict further movement of the bar thereby preventing the user from falling down the stairs.

11 Claims, 2 Drawing Sheets

STAIRWAY SAFETY BARS

FIELD OF THE INVENTION

This invention relates to a stairway safety device for persons needing assistance in walking up and down stairs and to protect such persons from falling down the stairs in the event the person stumbles.

BACKGROUND AND BRIEF DESCRIPTION OF THE PRIOR ART

The elderly or enfeebled require assistance in walking up and down stairways. Often the side bannister is an insufficient support or guide for such persons. Further, when the person loses his or her grip of the bannister, the person may fall down the stairs, possibly causing severe injury.

In U.S. Pat. No. 1,785,487, granted Dec. 16, 1980, to McAvoy, there is disclosed a stairway guard or gate which slides down and up a stairway. The user walks down the stairs while leaning on the gate. The rate of descent of the gate is set. The gate is opened at the bottom and when released at the bottom returns to the top of the stairs ready for the next person descending the stairs. The McAvoy structure is useful only in descent and there is no effective braking of the gate with the fall of the person.

U.S. Pat. No. 4,253,287, granted Mar. 3, 1981 to Overmoe, discloses walking bars which slide in guide slots, whereby the user can support his weight on the bar while moving up and down from one step to another. Should the user loses his grip of the bar, the user is free to fall. This is particularly so in ascending the stairs.

It was desired in the art to provide a stairway safety device to prevent the user from falling down the stairs in the event the user stumbles or loses his or her grip, in ascending or descending the stairs.

SUMMARY OF THE INVENTION

A pair of bars are mounted on a track disposed adjacent to and in a plane parallel to the plane of a stairway. The bars are hinged so that the user can lift one of the bars to step between the bars. The user grips or holds the bar in the direction of ascent or descent and proceeds to respectively, ascend or descend the stairs. Each bar is provided with a shoe which at one is end pivotally mounted to the respective bar, at the other end, the shoe is slidably disposed in the track. In ascending or descending the steps, the user pushes the bar and the shoe slides within the track. If the user stumbles and causes one of the bars to be pulled or pushed downwardly, the shoes pivots upwardly within the track to engaged high friction or braking surfaces to cause a braking action to impede the fall of the user. Additionally, the lower bar is provided with a plastic strip curtain or net to further prevent the user from falling beneath the lower bar and the stairs.

DESCRIPTION OF THE PREFERRED EMBODIMENTS

Referring to the FIGURES there is shown the stairway safety device of the present invention generally referred to as 10. Device is formed of two spaced parallel bars 11A and 11B. Bar 11A is disposed in the direction of descent and bar 11B is dis posed in the direction of ascent. Each bar 11A and 11B is similarly constructed except as otherwise described. Each bar is formed with a free end 13 and a track end 14, and a middle hinge or pivot connection 15, for purposes hereinafter appearing.

Figure 1:
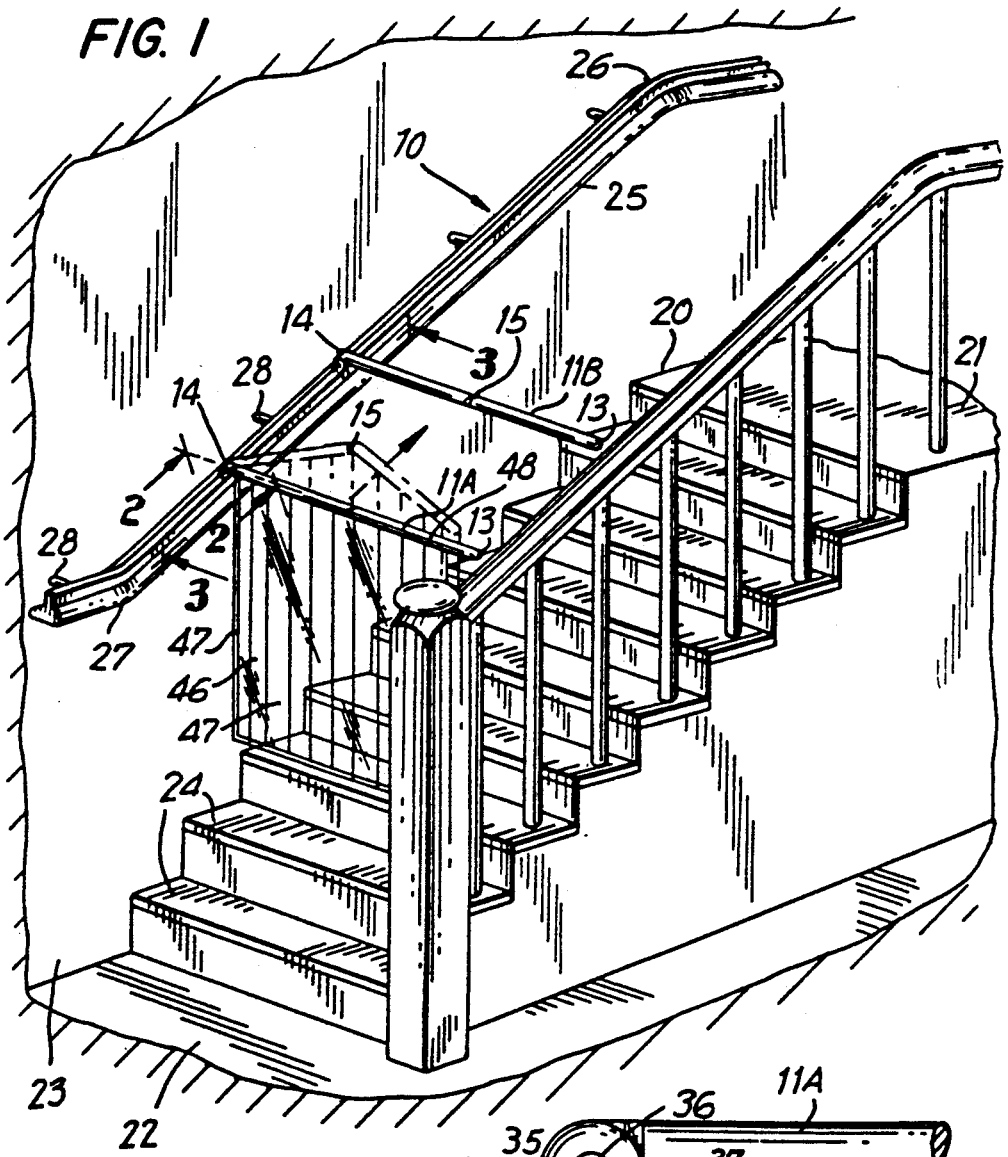
FIG. 1 is a perspective view of the stairway safety bars of the present invention installed on a stairway.

As shown in FIG. 1, bars 11A and 11B lie in a plane which is in a plane parallel to the plane in which the stairway 20 is disposed. Stairway 20 is juxtaposed to top landing 21 and bottom landing 22, and wall 23. Stairs 24 extend between the landings.

A track 25 is mounted to wall 23 at 28, and is parallel to the plane of the stairway. Track 25 curves at 26 to be parallel to landing 21, and curves at 27 to be parallel to landing 22. Track 25 is formed with slot 29.

Shoe 35 is disposed within track 25. The bottom 32 of track 25 is provided with a low friction element or insert 33 having curved portion 51. Insert 33 may be made of Teflon or like low coefficient of friction material. Insert 33 extends the length of track 25. It is to be noted that two shoes 35 are actually disposed, within track 25. Each shoe 35 is connected is made at pivot 36 which is disposed at the upper end of flange 37 of shoe 35. The lower end of shoe 35 is formed with symmetrical wings 38. A pair of high coefficient of friction elements or inserts 39 are fixedly mounted on wings 38 so as to be facingly disposed to tract inserts or elements 30. Inserts 30 extend the entire length of track 25. A curved or contoured Teflon insert 40 is fixedly mounted at the bottom 41 of track 25 so as to contour and facingly disposed track insert 33. Shoes 35 are flexibly interconnected by flexible plastic member or linkage 43.

Figure 2:
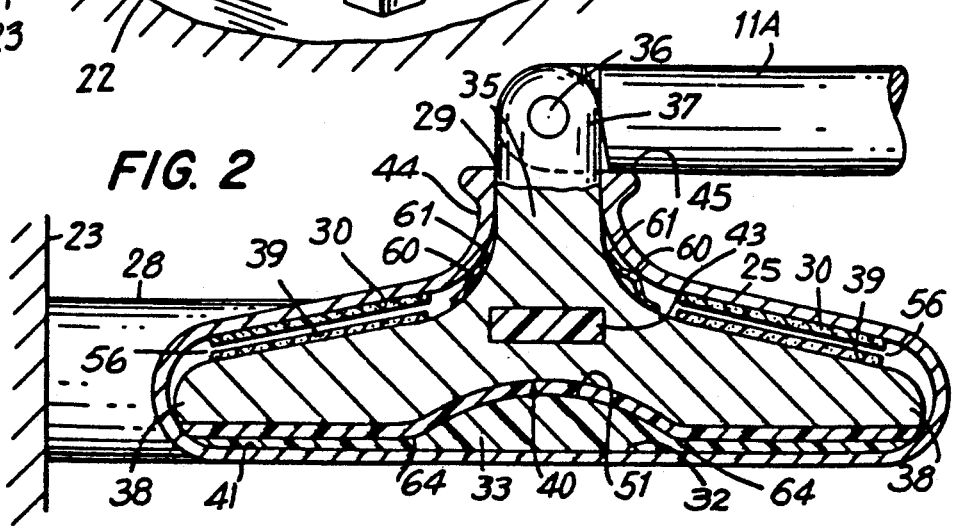
FIG. 2 is an enlarged sectional view taken along line 2—2 of FIG. 1 showing the stairway safety bars in the sliding mode.
Figures 3, 4:
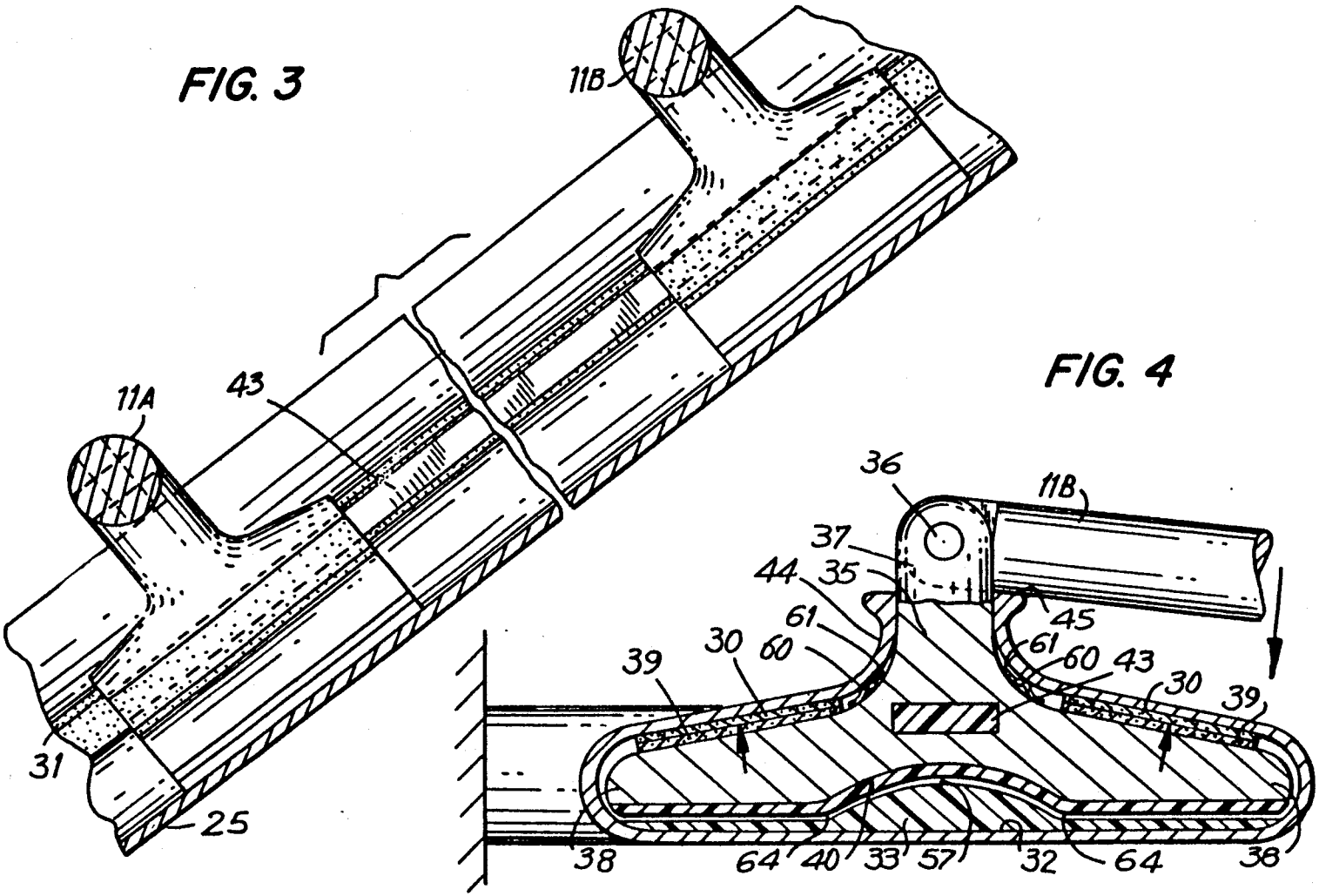
FIG. 3 is an enlarged sectional view taken along 3—3 of FIG. 1.
FIG. 4 is an enlarged sectional view taken along line 2—2 of FIG. 1, showing the stairway safety bars in the braking mode.

In order to maintain an even and constant bearing force between low friction inserts 33 and 40, a pair of strip or leaf springs 60 are fixedly mounted at one end 61 by known attachment means to shoe 35. The pressure exerted by springs 60 between the inside of the track and the outside of the shoe is sufficient to hold the inserts 33 and 40 in sliding engagement (FIG.2). When the user pulls downwardly on bar 11A, that force flatens springs 60 so that friction surfaces 39 and 31 are engaged (FIG. 4).

Track 25 is formed with an upstanding flange 44 having fulcrum surface 45. Bars 11A and 11B are disposed on surface 45. Bar 11A is provided with a curtain 46 formed of heavy plastic strips 47 which depend downwardly to slightly above stairs 24. Strips 47 are fixedly mounted at 48 to bar 11A.

To ascend the stairs, the user at bottom landing 22, pivots bar 11A at middle pivot connection 15. The user then steps between bars 11A and 11B, and re-pivots bar 11A to its straightened position. The user then grabs forward bar 11B and ascends the stairs while moving bar 11B upwardly. In moving bar 11A, low friction insert 40 of shoe 35 slides on low friction insert 33 of track 25. In this sliding mode, high friction inserts 39 of shoe 35 are spaced from opposed high friction inserts 30 of track 25, at clearance 56. Bar 11B slides on fulcrum edge or surface 45. Bar 11A is slidingly pulled by bar 11 through linkage 43.

In the event the user stumbles and pulls downwardly on bar 11B (or 11A in descent), then the bar will pivot about fulcrum 45 (see FIG. 4) and, in turn, shoe 35 will be lifted upwardly. The lifting of shoe 35 provides a clearance 57 between low friction inserts 40 and 33. Importantly, the lifting of shoe 35 causes high friction inserts 39 and 30 to become engaged. This engagement of the high friction surfaces provides a braking action to prevent the user from falling down the stairs. The harder the user pulls on the bar the more pronounced the braking action. In the event the user loses his grip of bar 11B and falls backwards, the body of the user will press downwardly on bar 11A. This downward pressing on the bar will cause shoe 35 of bar 11A to lift upwardly with the consequential engagement of high friction inserts 39 and 30 as previously discussed. Curtain 46 impedes the user from falling underneath bar 11A.

It is to be borne in mind that contour 51 of insert 33 is contoured, as well as the opposed contour of insert 40, so that if the user tended to twist or cock shoe 35 in track 25, one of the surface portions 64 will slide up on surface 33, to cause friction inserts 30 and 39 to become engage. This in turn will retard further twisting or cocking of the shoe in the track.

The user in descending the stairs from the top landing, positions himself between the bars 11A and 11B, and grabs bar 11A and proceeds to descend the stairs. In the event the user stumbles in descending the stairs, the user will cause bar 11A to be pushed or pulled downwardly, thereby causing the pivoting of the shoe 35 in track 25. This in turn causes the braking action as previously described. In the event the user begins to slip beneath bar 11A, further slipping will be impeded by curtain 46.

The material that may be used for the high friction braking surfaces or inserts are automobile brake show materials, roughened metals and the like. The track 25 and shoe 35 are shown as being constructed of metal, but it is also contemplated to use construction molded plastics, as are well known in the art. The preferred material for the low friction inserts is Teflon, although other plastics may be used.

It is to understood that while certain embodiments have been described, the invention contemplates other changes and modifications, such as by way of example, that the curtain of the lower safety bar may be in the form of a net with a weighted bottom. Other changes and modifications may be made without departing from the spirit or scope of the invention as defined in the adjoined claims.

What is claimed is:

1. A stairway safety device comprising: a track, and means to mount the track so that the track is parallel to the plane of the stairway, said track being formed with a slot;

a pair of bars, said bars being in spaced parallel disposition and being parallel to the stairs and disposed in the plane of the stairway, said space between the bars permitting a user to be disposed therebetween;

said track comprising means for mounting the bars for sliding movement within the track and means for restricting the movement of one of the bars when the bar is moved downwardly;

whereby the user in ascending or descending the stairs, steps between the bars and grips the bar forward in the direction of ascent or descent, the moves the bar in the respective direction of ascent or descent along the plane of the stairway and the bars slide within the track, and where the user in losing his balance causes a bar to move downwardly to engage the means for restricting movement, so that the bar is restricted from further movement to prevent the user from falling down the stairs.

2. The stairway safety device of claim 1, said means for restricting movement comprising friction elements

3. The stairway safety device of claim 1, each bar having a free end and a track end, and a shoe being disposed in said slot and means for mounting the shoe in said slot.

4. The stairway safety device of claim 3, said means for restricting movement comprising a friction element disposed on said shoe and an oppositely disposed friction element disposed on the track within the slot.

5. The stairway safety device of claim 4, said means for sliding comprising a low friction surface element and means to resiliently mount the low friction surface element so that the shoe slides along the surface, and with said downward movement the friction elements frictionally engaged to restrict further movement of the bar.

6. The stairway safety device of claim 4, further comprising means to pivotally connect the shoes.

7. The stairway device of claim 1, each bar comprising a middle pivot element so as to move the bar for access between the bars.

8. The stairway safety device of claim 1, said bar disposed in the forward descent direction being formed with catch elements depending from the bar to slightly above the stairs, so as to prevent the user from falling below the last said bar.

9. The stairway safety device of claim 4, means for pivotally connecting the bar to the shoe.

10. The stairway safety device of claim 1, said track extending beyond the plane of stairway to be in a plane parallel to landings at the ends of the stairway.

11. The stairway safety device of claim 8, said catch elements comprising a curtain.

* * * * *